US005769162A

United States Patent [19]

Bartlett et al.

[11] Patent Number: 5,769,162

[45] Date of Patent: Jun. 23, 1998

[54] DUAL BORE ANNULUS ACCESS VALVE

[75] Inventors: Christopher D. Bartlett; Christopher E. Cunningham, both of Spring, Tex.

[73] Assignee: FMC Corporation, Chicago, Ill.

[21] Appl. No.: 621,850

[22] Filed: Mar. 25, 1996

[51] Int. Cl.[6] ..... E21B 34/02

[52] U.S. Cl. ..... 166/87.1; 166/321

[58] Field of Search ..... 166/87.1, 86.2, 166/86.1, 88.1, 88.4, 321, 368

[56] References Cited

U.S. PATENT DOCUMENTS

| | | | |
|---|---|---|---|
| 4,049,052 | 9/1977 | Arendt | 166/321 |
| 4,449,583 | 5/1984 | Lawson | 166/321 |
| 4,807,700 | 2/1989 | Wilkins | 166/86 |
| 4,848,457 | 7/1989 | Lilley | 166/87 |
| 4,869,318 | 9/1989 | Kellett | 166/87 |
| 4,903,774 | 2/1990 | Dykes et al. | 166/321 |
| 4,958,686 | 9/1990 | Patch | 166/348 |
| 5,040,606 | 8/1991 | Hopper | 166/319 |
| 5,143,158 | 9/1992 | Watkins et al. | 166/344 |
| 5,503,230 | 4/1996 | Osborne et al. | 166/321 |

FOREIGN PATENT DOCUMENTS

| | | |
|---|---|---|
| 2049765 | 12/1980 | United Kingdom . |
| 2214543 | 9/1989 | United Kingdom . |

*Primary Examiner*—Hoang C. Dang
*Attorney, Agent, or Firm*—Henry C. Query, Jr.

[57] ABSTRACT

The present invention is directed to an annulus access valve system for selectively opening and sealing an annulus bore in a wellhead apparatus comprising an annular bore insert sealingly and fixedly attached within the annulus bore; at least one flow port formed in the bore insert for establishing a fluid path through the annulus bore; an annular valve sleeve sealingly and slideably attached within the bore insert; and a hydraulic actuator for raising and lowering the valve sleeve over the flow port; whereby the sleeve may be actuated to open the flow port and thereby open the annulus bore and the sleeve may be actuated to close the flow port and thereby seal the annulus bore.

2 Claims, 2 Drawing Sheets

DUAL BORE ANNULUS ACCESS VALVE

Background of the Invention

1. Field of the Invention

The present invention is related to a subsea wellhead apparatus and, more particularly, to an annulus access valve for use in the annulus bore of a tubing hanger to permit the well annulus to be selectively sealed.

2. Description of the Related Art

Within a typical subsea well completion, there are a series of casing strings initiating within a welihead housing located at the seabed and continuing downward. The last casing is typically called the production tubing, This string is suspended within the wellhead by a tubing hanger and extends down to the production zone of the well. The tubing hanger includes a production bore extending therethrough for allowing communication between the subsea equipment connected to the wellhead and the production tubing. Similarly, the tubing hanger also comprises an annulus bore extending therethrough for providing access between the subsea equipment and the well annulus surrounding the production tubing. When a xmas tree or a blow out preventer (BOP) is being attached to or disconnected from the wellhead, both the production bore and the annulus bore must be sealed. In addition, when oil or gas is being produced through the production bore, the annulus bore must be open to permit the well annulus to vent. Therefore, a need exists for an annulus access valve that can selectively open and seal the annulus.

In prior art welihead systems, various devices have been used to seal the annulus bore. One of the most common devices is a wireline-deployed isolation plug which is set in a sealing profile in the tubing hanger. In this device, the seals which isolate the annulus bore are not permanently installed; they are retained on the wireline-set plug which is pulled once the subsea equipment is installed. Another prior art device is a spring-loaded check valve which can be mechanically opened after the subsea equipment is installed. This device simplifies the system by eliminating the wireline-set isolation plug, but because of safety concerns, such as the check valve not being easily testable, it is not used extensively outside of Brazil. A further prior art device is an annular sliding sleeve valve which is hydraulically actuated to open or seal the annulus bore. However, this valve is typically permanently installed. Thus, the valve seals are not replaceable without retrieving the entire tubing hanger to the surface, which is a very expensive operation. In addition, prior art sleeve valves lack means of providing a back-up seal in case of a failure of the primary seal.

SUMMARY OF THE INVENTION

Therefore, it is an object of the present invention to provide an annulus access valve that does not require the use of a wireline-set plug in its primary mode of operation, but which may be used in conjunction with a wireline-set plug as a contingency if the primary seal fails.

According to the present invention, these and other objects and advantages are achieved by providing an annulus access valve having a sleeve which is hydraulically actuated between an up and down position, a bore insert defining a series of flow ports through the annulus bore, and two sets of seals located between the sleeve and the bore insert. When the sleeve is in the down position, the two sets of seals straddle the flow ports and thereby isolate the well annulus below from the subsea equipment above. When the sleeve is in the up position, the flow ports are exposed and free flow is obtained between the well annulus and the subsea equipment. The annulus access valve also comprises a wireline tool profile located on the inner surface of the sleeve. This allows a wireline tool to engage the sleeve and actuate it up or down in the event of a failure in the hydraulic system. Furthermore, the annulus bore includes a wireline plug profile located above the annulus access valve which will accept a wireline-set isolation plug and seal the annulus bore in the event of a failure of the annulus access valve.

These and other objects and advantages of the present invention will be made apparent from the following detailed description, with reference to the accompanying drawings.

DETAILED DESCRIPTION OF THE PREFERRED EMBODIMENTS

Figure 1:
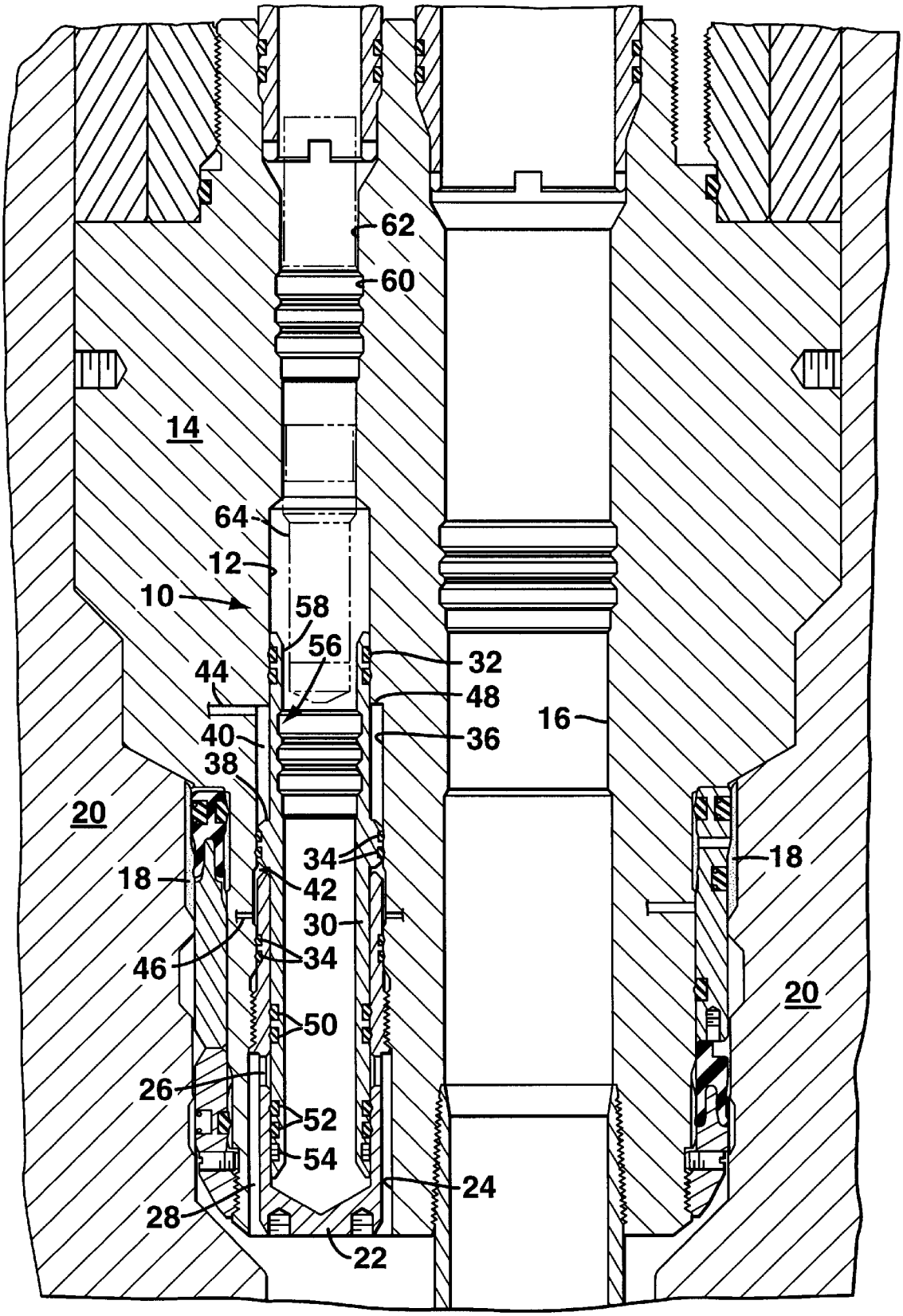
FIG. 1 is a cross-sectional view of a tubing hanger incorporating the annulus access valve of the present invention.

Referring to FIG. 1, the annulus access valve system of the present invention, indicated generally by reference number 10, is shown incorporated into an annulus bore 12 extending through a tubing hanger 14. Tubing hanger 14 also includes a production bore 16 and means 18 for sealing tubing hanger 14 against the wellhead 20. As can be seen in FIG. 1, annulus bore 12 is a single bore offset from production bore 16.

Valve system 10 comprises an annular bore insert 22 which is sealingly and fixedly attached within a lower portion 24 of annulus bore 12. A series of flow ports 26 is formed in bore insert 22, and a flow path 28 leading to flow ports 26 is defined between bore insert 22 and the lower portion 24 of annulus bore 12. Flow ports 26 thus establish the sole fluid paths within annulus bore 12.

Valve system 10 also comprises an annular valve sleeve 30 which is slideably received within both annulus bore 12 and bore insert 22. Valve sleeve 30 includes a set of upper hydraulic seals 32 and a set of lower hydraulic seals 34, both of which seal against an intermediate portion 36 of annulus bore 12. Valve sleeve 30 also includes an enlarged diameter section 38 formed adjacent lower hydraulic seals 34. Intermediate portion 36 is designed such that an upper annulus 40 is formed above enlarged diameter section 38 and a lower annulus 42 is formed below enlarged diameter section 38. A hydraulic port 44 is in communication with upper annulus 40 and a controlled source of hydraulic fluid (not shown), and a similar hydraulic port 46 is in communication with lower annulus 42 and the controlled source of hydraulic fluid. Downward motion of valve sleeve 30 is limited by the interaction of enlarged diameter section 38 and the upper end of bore insert 22, while upward motion of valve sleeve 30 is limited by the interaction of enlarged diameter section 38 and a shoulder 48 formed in annulus bore 12.

Valve sleeve 30 further comprises a set of upper flow seals 50 and a set of lower flow seals 52. Flow seals 50 and 52 are constructed, for example, of an elastomeric material to effectively seal valve sleeve 30 against bore insert 22 while at the same time allowing for relative movement therebetween. Valve sleeve 30 also includes a set of piston rings 54 located below lower flow seals 52. In the closed position of valve sleeve 30, which is depicted in FIG. 1, upper and lower flow seals 50 and 52 straddle flow ports 26 to effectively seal annulus bore 12.

Figure 2:
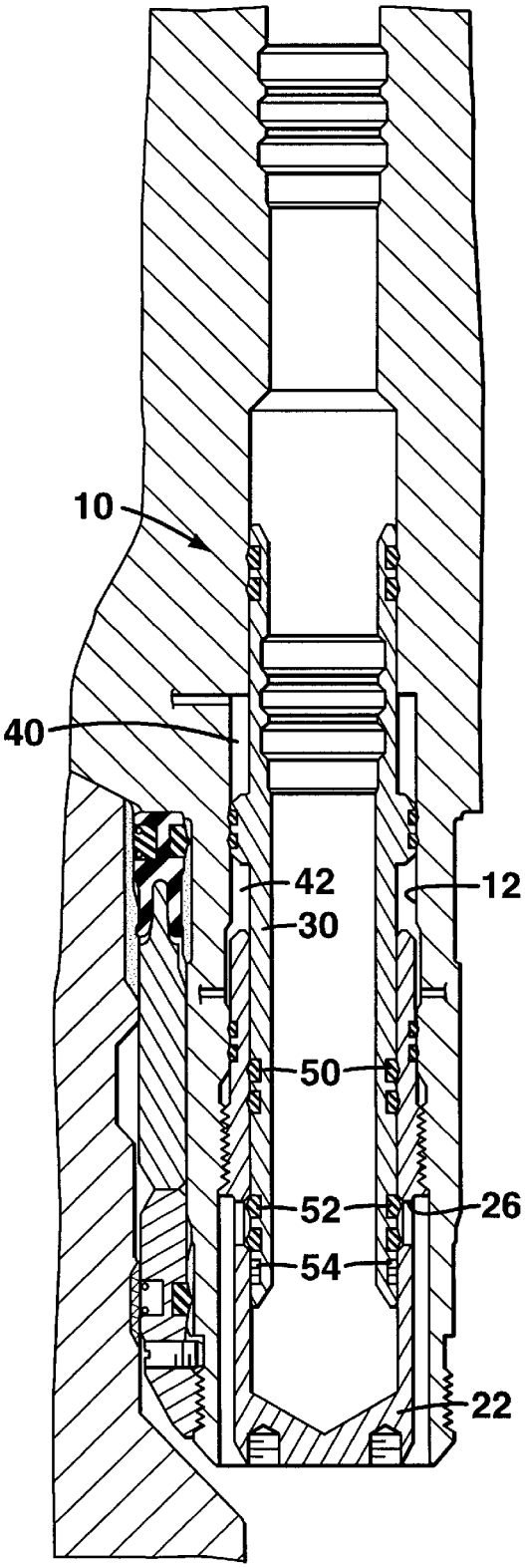
FIG. 2 is a cross-sectional view of a portion of the tubing hanger depicted in FIG. 1 showing the annulus access valve in a partially open position.
Figure 3:
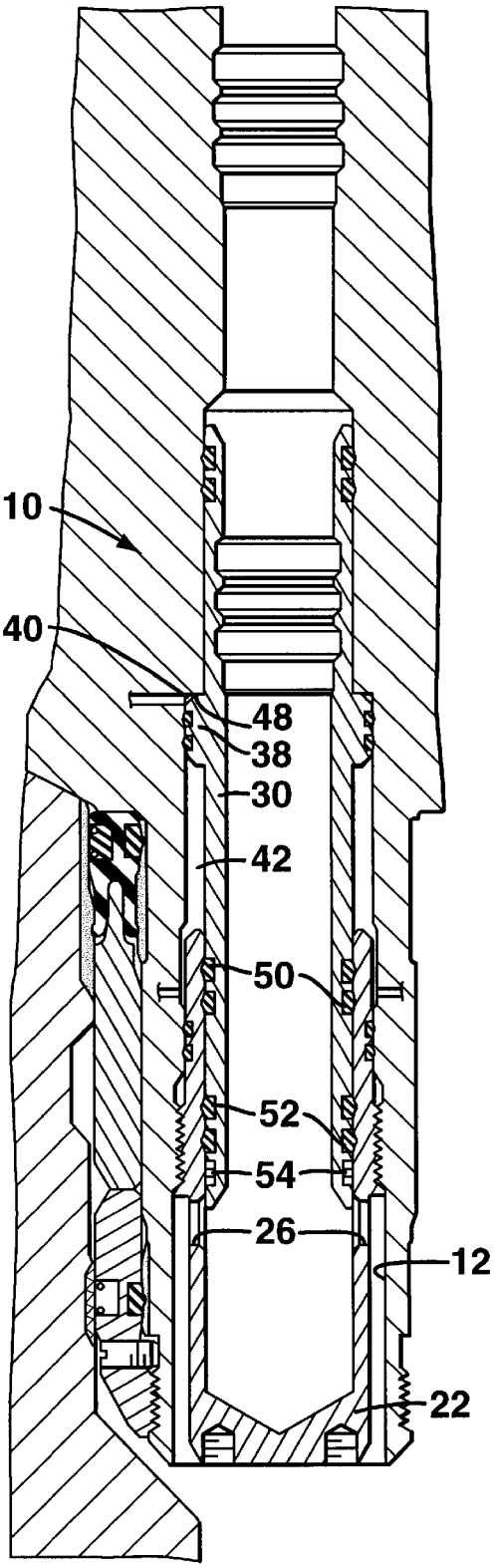
FIG. 3 is a cross-sectional view of a portion of the tubing hanger depicted in FIG. 1 showing the annulus access valve in a fully open position.

In operation of valve system 10, a suitable hydraulic control switch (not shown) is actuated to inject hydraulic fluid into lower annulus 42 to raise valve sleeve 30, as shown in FIG. 2. As lower flow seals 52 pass flow ports 26, piston rings 54 prevent the flow seals from being washed out. Valve sleeve 30 continues upward until enlarged diameter section 38 engages shoulder 48 in annulus bore 12, as shown in FIG. 3. In this position, flow ports 26 are fully open, allowing complete communication between the well annulus below and the subsea equipment above. In order to seal annulus bore 12, the hydraulic control switch is actuated to inject hydraulic fluid into upper annulus 42. This forces valve sleeve 30 downward until enlarged diameter section 48 engages the upper end of bore insert 22. In this position (FIG. 1), upper and lower flow seals 50 and 52 straddle flow ports 26, thereby effectively sealing the well annulus from the subsea equipment.

Referring again to FIG. 1, valve system 10 preferably also comprises a wireline tool profile 56 formed on the inner surface 58 of valve sleeve 30. This allows a wireline tool to engage valve sleeve 30 and raise and lower it into the open and closed positions in the event of a failure of the hydraulic system.

Valve system 10 may also comprise a wireline isolation plug profile 60 formed in an upper portion 62 of annulus bore 12 above valve sleeve 30. This allows an isolation plug to be wireline-set into annulus bore 12 to seal annulus bore 12 in the event of a failure of valve sleeve 30.

It should be recognized that, while the present invention has been described in relation to the preferred embodiments thereof, those skilled in the art may develop a wide variation of structural details without departing from the principles of the invention. Therefore, the appended claims are to be construed to cover all equivalents falling within the true scope and spirit of the invention.

What is claimed is:

1. An annulus access valve system for selectively opening and sealing an annulus bore in a wellhead apparatus comprising:

an annular bore insert sealingly and fixedly attached within the annulus bore;

at least one flow port formed in the bore insert for establishing a fluid path through the annulus bore;

an annular valve sleeve sealingly and slideably attached within the bore insert; and hydraulic means for raising and lowering the valve sleeve over the flow port;

whereby the sleeve may be actuated to open the flow port and thereby open the annulus bore and to close the flow port and thereby seal the annulus bore;

a wireline tool profile formed in the valve sleeve; and a wireline tool;

wherein the wireline tool engages the wireline tool profile to provide a means for manually opening and closing the valve sleeve.

2. An annulus access valve system for selectively opening and sealing an annulus bore in a wellhead apparatus comprising:

an annular bore insert sealingly and fixedly attached within the annulus bore;

at least one flow port formed in the bore insert for establishing a fluid path through the annulus bore;

an annular valve sleeve sealingly and slideably attached within the bore insert; and hydraulic means for raising and lowering the valve sleeve over the flow port;

whereby the sleeve may be actuated to open the flow port and thereby open the annulus bore and to close the flow port and thereby seal the annulus bore;

a wireline isolation plug profile formed in the annulus bore above the valve sleeve; and a wireline isolation plug;

wherein the wireline isolation plug engages the isolation plug profile to seal the annulus bore.

* * * * *